US005360312A

United States Patent [19]

Mozingo

[11] Patent Number: 5,360,312

[45] Date of Patent: Nov. 1, 1994

[54] THREE FUNCTION CONTROL MECHANISM

[75] Inventor: Robert E. Mozingo, Burlington, Iowa

[73] Assignee: Case Corporation, Racine, Wis.

[21] Appl. No.: 922,171

[22] Filed: Jul. 29, 1992

[51] Int. Cl.[5] ..... E02F 3/28

[52] U.S. Cl. ..... 414/685; 74/471 XY; 137/636.2; 414/4

[58] Field of Search ..... 414/685, 694, 4, 715; 74/471 XY, 529, 538; 137/636.3, 636.2; 244/234

[56] References Cited

U.S. PATENT DOCUMENTS 3,741,031 6/1973 Schwerdtfeger .
3,831,633 8/1974 Comer .
3,854,380 12/1974 Casey .
3,897,805 8/1975 Casey .
3,943,791 3/1976 Casey .
4,019,401 4/1977 Drone .
4,028,958 6/1977 Schuermann et al. .
4,187,737 2/1980 Mori et al. .
4,523,488 6/1985 Ahrendt .
4,667,909 5/1987 Curci ..... 244/234
4,736,647 4/1988 Shimoie et al. .
4,938,091 7/1990 Waggoner et al. .
4,978,273 12/1990 Radke et al. .
5,112,184 5/1992 Tapper et al. ..... 414/4 X
5,142,931 9/1992 Menahem ..... 244/234 X

*Primary Examiner*—Donald W. Underwood
*Attorney, Agent, or Firm*—Rudnick & Wolfe

[57] ABSTRACT

A three function control mechanism for independently or conjointly controlling three separate functions of an off-highway implement. The control mechanism basically includes lever means accessible to the operator of the implement and connected to a singular modular controller having three separate actuator means arranged relative to various pivotal axes of the controller for effecting the three functions either independently or conjointly relative to each other.

14 Claims, 6 Drawing Sheets

THREE FUNCTION CONTROL MECHANISM

FIELD OF THE INVENTION

The present invention relates to a three function control mechanism including a control handle mounted to a single modular controller to allow for manipulation of the control lever in a manner offering control over three separate hydraulic valves.

BACKGROUND OF THE INVENTION

Off-highway implements, such as front-end loaders and the like are typically provided with a loader mechanism at one end thereof. A conventional loader mechanism includes a working tool such as a bucket or the like pivotally connected to a frame of the implement by longitudinally extending loader arms. A series of hydraulic actuators, usually in the form of double-acting hydraulic cylinders, are connected to a hydraulic system of the implement for effecting various loader functions. Hydraulic actuators are used to elevate the bucket or tool by raising and lowering the loader arms. Hydraulic actuators are likewise used to control the roll or pivotal movement of the bucket relative to the loader arms. Many loader mechanisms further incorporate a device such as a clam shell bucket which utilize other hydraulic actuators for controlling articulated movements of the clam shell bucket to effect a "grab" function.

Control over the various loader functions or work operations is conventionally achieved through manipulation of various control levers. Each control lever is typically connected to a controller which serves to mount the control lever to the implement frame and includes a linkage mechanism for transferring and translating movement of the control lever into positional movements for a control valve. The control valve, in turn, regulates hydraulic fluid flow between a pressurized hydraulic source on the implement and each of the actuators.

In addition to controls for the loader mechanism, a cab region of an off-highway implement is replete with other mechanisms and devices for regulating braking, steering, and speed of the implement. Typically, such devices include linkage mechanisms including a series of interconnected links for transferring movement in response to an operator's controls. As will be appreciated, such linkage mechanisms are independently operable and thus must be sufficiently spaced from each other to accommodate the various movements of the links without causing interferences therebetween. Accordingly, space availability beneath and about the cab area of an off-highway implement is severely limited. Adding separate controllers to allow for manipulation of each control lever further complicates the control mechanism of the off-highway implement and further complicates space availability in an area already replete with moving mechanisms. The addition of separate controllers for each control lever also adds significantly to manufacturing costs by requiring substantially duplicative parts for the different control levers.

During operation of the implement, the loader mechanism can perform a single function but usually at least two loader functions are affected simultaneously. That is, while the loader arms are being elevationally positioned, the pivotal position or roll of the bucket may likewise be adjusted. When equipped with a clam shell bucket, all three loader functions may be effected simultaneously to economize on operational time for the implement. As will be appreciated, controlling the implement's direction and speed simultaneously with raising, lowering, tilting, and articulating the bucket of the loader mechanism through movement of a multiplicity of control levers can become a cumbersome task for anyone to perform successfully.

Thus, there is a need and a desire for a three function control mechanism including a single controller for mounting a control handle to the frame of the implement such that various loader functions can readily be effected either independently of one another or in unison with one another or, in any combination desired by the operator with a minimum number of parts so as to reduce the complexity of the mechanisms for accomplishing these results.

SUMMARY OF THE INVENTION

In view of the above, and in accordance with the present invention, there is provided a control mechanism for independently or conjointly controlling three separate functions. To minimize the number of parts involved and, thus, reducing its complexity, the control mechanism of the present invention basically includes a control handle connected to a single modular controller having three separate actuators arranged relative to various pivotal axes of the controller for effecting the three functions, either independently or conjointly relative to each other, through induced movement of the controller. Although separate linkages connect each actuator to a hydraulic valve, a salient feature of the present invention concerns the use of a single controller operable under the influence of the control handle for regulating up to three different hydraulic valves thereby controlling three different functions.

In one embodiment of the invention, the control handle includes an elongated lever connected to the controller for movement in four different directions, with each direction extending away from a neutral position. Two functions are accomplished through movement of the control lever. An operator handle assembly is connected to an upper end of the lever for twisting pivotal movements relative thereto. The third function is accomplished in response to twisting manipulation of the operator handle assembly. Such an arrangement facilitates one-handed control of each of three different hydraulic valves.

The operator handle assembly includes an operator handle pivotally mounted for movement in opposite directions away from a neutral position. A force transfer assembly extends from the operator handle and translates movement of the handle into positional movements of a hydraulic valve. In a preferred form of the invention, the force transfer assembly includes a substantially vertical link extending through an elongated lever and is connected to the operator handle in radially spaced relation to the pivot axes of the operator handle. The link is disposed for vertical reciprocatory movement and is connected at a lower end to a lever adapted for pivotal movement. The lever of the force transfer assembly can either be carried on the controller or mounted separately therefrom.

In another embodiment of the invention, and to accommodate those who desire to maintain two separate control levers for controlling various functions, the control handle of the control mechanism is comprised of two separate handles connected to the controller.

One handle is adapted to induce movement of the first and second actuators on the controller thus controlling two functions. The other handle likewise is capable of inducing movement to the second actuator means and is furthermore capable of inducing movement to the third actuator. As is apparent, induced movement of the second actuator and, thereby, control over the second function of the control mechanism, can be effected through suitable movements of either handle.

An advantage of the present invention is that a modular controller can be used to mount either embodiment of the control handle to a frame of a loader. In a preferred form, the controller has a bracket-like configuration which is adapted for rotation about and is inhibited for endwise movement along a first fixed axis. The controller bracket arranges a first ball joint in radially spaced relation to the first axis of the bracket. Movements of the control handle in a first control arc centered about the first axis effects movements of the first ball joint actuator. A first linkage extends from the first actuator for operating a first hydraulic valve and thereby regulating a first function in response to induced movements of the bracket about the first axis.

The controller arranges the second actuator in alignment with the first axis and in radially spaced relation to a second pivot axis extending generally normal to the first pivot axis. Movements of the control handle in a control arc centered about the second axis effects movement of the second actuator and, through a suitable second linkage, effects positional movements of a hydraulic valve for controlling a second function of the control mechanism.

In the embodiment wherein an operator handle assembly is mounted to an upper end of the control handle, the vertical link of the force transfer assembly extends substantially perpendicular to and intersects the first and second pivot axes. Accordingly, the operator can use a single hand to independently actuate one of the hydraulic valves through manipulation of either the control handle connected to the controller or the operator handle assembly, or to conjointly actuate two or more of the hydraulic valves through manipulation of the control handle connected to the controller and the operator handle assembly.

The three function control mechanism of the present invention is particularly useful for independently or conjointly controlling three different operator functions of a front-end loader including a loader mechanism supported from a wheeled frame. As is conventional, the loader mechanism includes a pair of loader arms pivotally attached to the frame at one end thereof for movement about a generally horizontal axis. A loader bucket including a base member and a movable member is pivotally attached to the distal ends of the loader arms. The movable member of the loader bucket is adapted for articulated movement about a transversely extending axis between open and closed positions. The loader further includes a hydraulic system including a pressurized fluid source connected to first, second, and third hydraulic actuators for effecting various loader functions, including: elevating the bucket relative to the frame; pivoting the bucket relative to the loader arms; and articulately moving the movable member relative to the base member to effect a "grab" function. As will be appreciated, the control mechanism of the present invention is interposed between the pressurized fluid source and the hydraulic actuators for selectively controlling operation of the loader mechanism under the influence of the operator.

The bracket-like controller of the control mechanism is preferably designed as a yoke including a pair of spaced parallel arm portions on opposite sides of the first pivot axis and a mounting portion. In a most preferred form of the invention, the mounting portion of the controller is journalled in a bearing assembly which supports the controller for movement in either rotational direction about the first axis.

The controller further includes an inverted U-shaped mounting to which the control handle is releasably secured. The control handle mounting is connected with two axially aligned pins to the arm portions of the yoke to define the second pivot axis of the controller. The releasable connection between the mounting and the control lever allows a handle to be connected to the controller to replace the control lever and enhance the versatility of the control mechanism.

With the present invention, three different functions are controlled through control handle carried by the modular controller. Suitable movement of the control handle induces movement of separate actuators carried by the controller thus reducing the parts and significantly reducing the complexity of heretofore known control mechanisms. The simplicity of the present invention further allows inexpensive manufacture of the control mechanism and durable operation thereof.

These and numerous other features and advantages of the present invention will become readily apparent from the following detailed description, the accompanying drawings, and the appended claims.

DETAILED DESCRIPTION OF THE INVENTION

Figure 1:
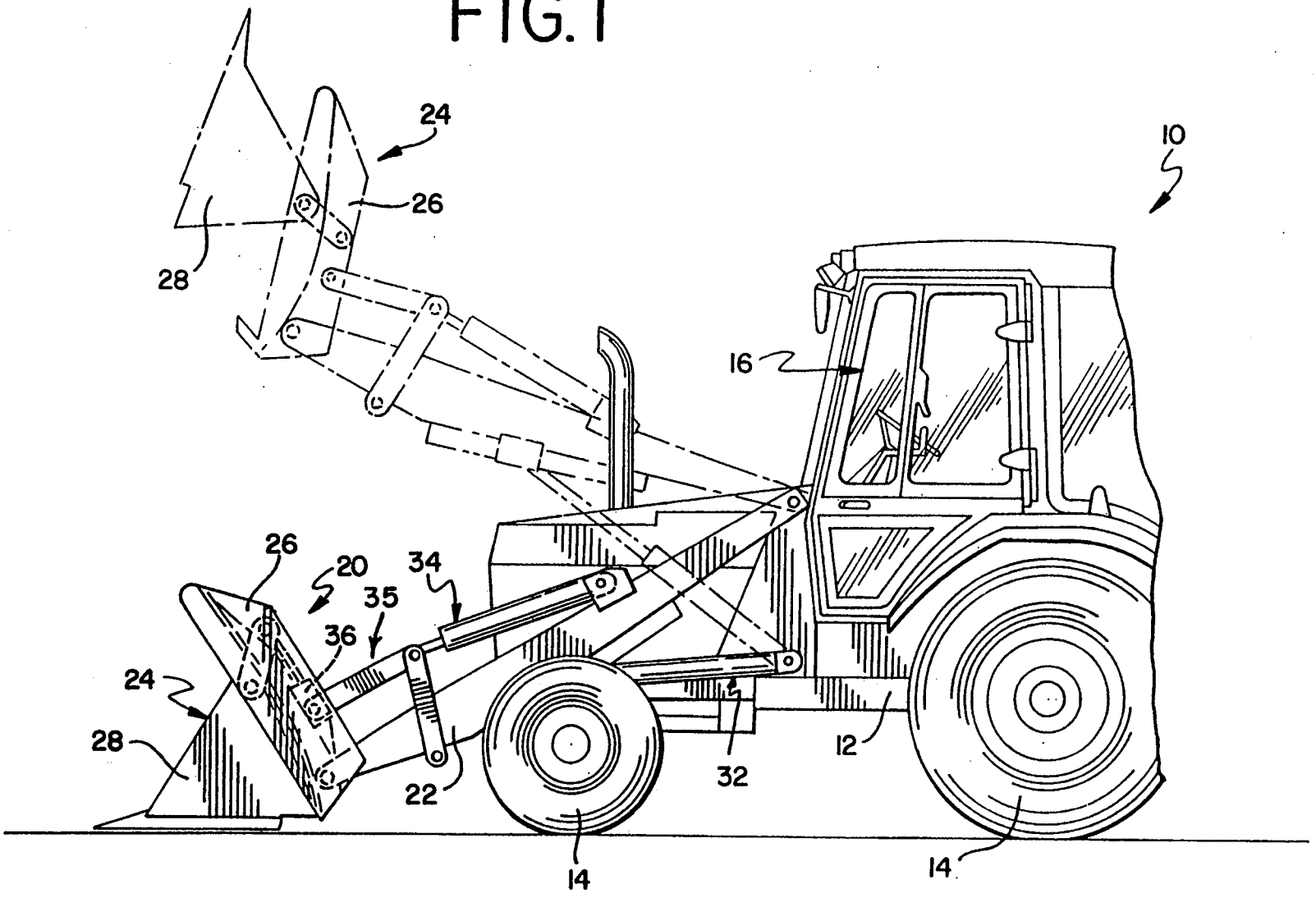
FIG. 1 is a side elevational view of an off-highway implement in the form of a front-end loader incorporating principles of the present invention.

While the present invention is susceptible of embodiment in various forms, there is shown in the drawings preferred embodiments of the invention which are hereinafter described, with the understanding that the disclosures which are presented are to be considered as exemplifications of the invention and are not intended to limit the invention to the specific embodiments illustrated.

Referring now to the drawings, wherein like reference numerals indicate like parts throughout the several views, FIG. 1 schematically shows an off-highway implement such as a front-end loader designated generally by reference numeral 10. Loader 10 includes a frame 12 provided with wheels 14 to permit mobile movement of the loader over the ground. Loader 10 further includes an operator station or cab region 16 in which various operative controls are conveniently accessible to permit the operator to control various loader functions. Although the control mechanism of the present invention is described as being arranged on a front-end loader, the invention should not be so limited as it may be equally applied to other off-highway implements which would be facilitated by a control mechanism capable of individually or conjointly affecting up to three functions of the implement.

Loader 10 also includes a loader mechanism 20 supported from the frame for handling of materials. As is conventional, loader mechanism 20 includes a pair of fore-and-aft extending loader arms 22 pivotally connected to the frame 12 for elevational movements about a generally horizontal axis. A working tool 24, such as a bucket, is pivotally connected between the distal ends of the arms 22 for pivotal or rolling movements. In the illustrated embodiment, bucket 24 is capable of independent articulated movement such as shown in phantom lines in FIG. 1. Such a bucket typically includes a base member 26 connected to the loader arms 22 and a clam member 28 pivotally supported from the base member 26 and movable relative thereto between open and closed positions to effect a "grab" function for the loader mechanism.

Loader 10 is further provided with a hydraulic system including a hydraulic fluid source (not shown) for providing pressurized hydraulic fluid to various hydraulic actuating components of loader 10. The hydraulic system includes a pair of hydraulic actuators 32 interconnected between frame 12 and loader arms 22 to elevationally position the bucket 24 relative to the frame 12. Similarly, a pair of hydraulic actuators 34 interconnect loader arms 22 through a linkage 35 to the bucket 24 to effect pivotal or rolling movement of the bucket relative to the loader arms 22. The hydraulic system also includes hydraulic actuators 36 interconnecting the base member 26 of bucket 24 to the movable member 28 to effect articulated 10 movement of member 28 relative to member 26 between open and closed positions. Each of the hydraulic actuators 32, 34, and 36 are preferably in the form of linearly extendable/retractable hydraulic cylinders which are provided with conventional plumbing connections to provide hydraulic fluid under pressure thus effecting various loader functions as controlled by the operator.

A control mechanism 40 according to the present invention is provided between the power source and the actuators 32, 34, and 36 for selectively controlling the loader functions. In the embodiment illustrated in FIG. 2, control mechanism 40 is used to operate a valve assembly 41 mounted on the frame of the loader and including valves 42, 44, and 46. As is conventional, each valve 42, 44, and 46 includes a valve stem 48 which positions a spool valve (not shown) thereby regulating fluid through the respective valve. As shown, valve 42 controls operation of the lift actuators 32; valve 44 controls operation of the tilt actuators 34; while valve 46 controls operation of the clam shell actuators 36.

The control mechanism 40 for operating the valve mechanism 41 and thereby the loader mechanism 20 includes a modular controller 50 for mounting a control handle 52 to the frame 12 of the implement. As will be discussed in detail hereinafter, the single modular controller 50 is capable of operating all three valves 42, 44, and 46, and thus independently or conjointly controlling all three functions of the loader mechanism in response to movements induced thereto by the control handle 52.

The single modular controller 50 includes first and second interconnected bracket assemblies 54 and 56, respectively. The first bracket assembly 54 10 mounts the control mechanism 40 to the loader frame 12 and, more particularly, allows manipulation or movement of the control handle 52 in a first control arc centered about a first pivot axis 58. The first bracket assembly 54 includes a first actuator 60 responsive to movements of the first bracket assembly 54 about axis 58 and operative to effectively control one function of the loader mechanism.

The second bracket assembly 56 is pivotally connected to and movable with the first bracket assembly 54 and allows manipulation or movement of the control handle 52 about a second pivot axis 62. Notably, pivot axes 58 and 62 extend generally normal to each other. The a second bracket assembly 56 includes second actuator 64 responsive to movements of the bracket assembly 56 about the pivot axis 62 and operative to effectively control a second function of the loader mechanism. In the illustrated embodiment, the actuator 64 is disposed in substantially the same horizontal plane as actuator 60 when the control handle is in a neutral position.

Figure 3:
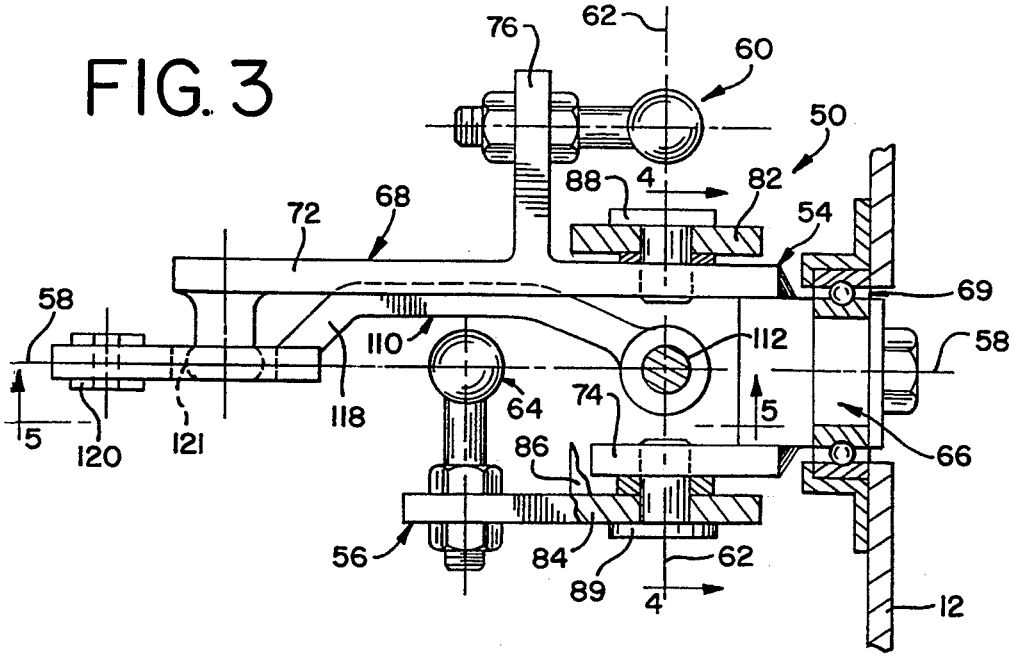
FIG. 3 is a top plan view of the control mechanism illustrated in FIG. 2.
Figure 4:
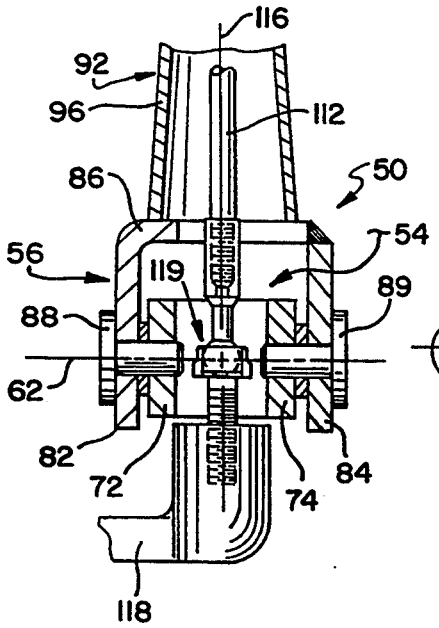
FIG. 4 is a fragmentary sectional view taken along line 4—4 of FIG. 3.

Turning to FIGS. 3 and 4, bracket assembly 54 is preferably configured with a mounting portion 66 and a yoke portion 68. As shown, mounting portion 66 of bracket assembly 54 is journalled within a bearing assembly 69 carried by the loader frame 12 to allow for rotation of the bracket assembly 54 while inhibiting endwise movement of the bracket assembly 54 along axis 58. Yoke portion 68 of bracket assembly 54 includes a pair of generally parallel extending and spaced arm portions 72 and 74 arranged on opposite sides of axis 58. In the illustrated embodiment, an extension 76 projects outwardly from the arm portion 72 for mounting the actuator 60 in radially spaced relation to axis 58.

Returning to FIG. 2, the first actuator 60 of the modular controller 50 preferably includes a spherical coupling or ball joint which is connected through suitable linkage 80 to valve stem 48 of valve 44. Accordingly, upon induced rotation of the controller 50 about axis 58, the actuator 60 moves to either side of a neutral position resulting in displacement of the valve spool of valve 44 to effect operation of hydraulic actuator 34 and thereby pivotal movement or roll of the bucket 24 relative to the loader arms 22.

Returning to FIGS. 3 and 4, the second bracket assembly 56 includes a mounting member having an inverted U-shaped cross-sectional configuration including a pair of parallel arm portions 82, 84 joined to each other at their upper ends by a bridge portion 86. The arm portions 82, 84 of bracket assembly 56 straddle and are pivotally attached to the arm portions 72, 74, respectively, of bracket assembly 54. A pair of axially aligned pins 88 and 89 pivotally interconnect the bracket assemblies 54 and 56 to each other and define the second pivot axis 62 of controller 50.

Arm portion 84 of bracket assembly 56 preferably carries and arranges the actuator 64 in radially spaced relation to the second pivot axis 62. Notably, the actuator 64 extends from the arm portion 84 and is centered or aligned with the first pivot axis 58 of the controller 50.

Returning to FIG. 2, the second actuator 64 of the modular controller 50 preferably includes a spherical coupling or ball joint connected through suitable linkage 90 to valve stem 48 of valve 42. Accordingly, upon induced rotation of the controller 50 about axis 62, the second actuator 64 moves to either side of a neutral position resulting in displacement of the valve spool of valve 42 to effect operation of hydraulic actuators 32 thereby adjusting the elevation of the bucket 24 relative to the frame 12.

Figure 2:
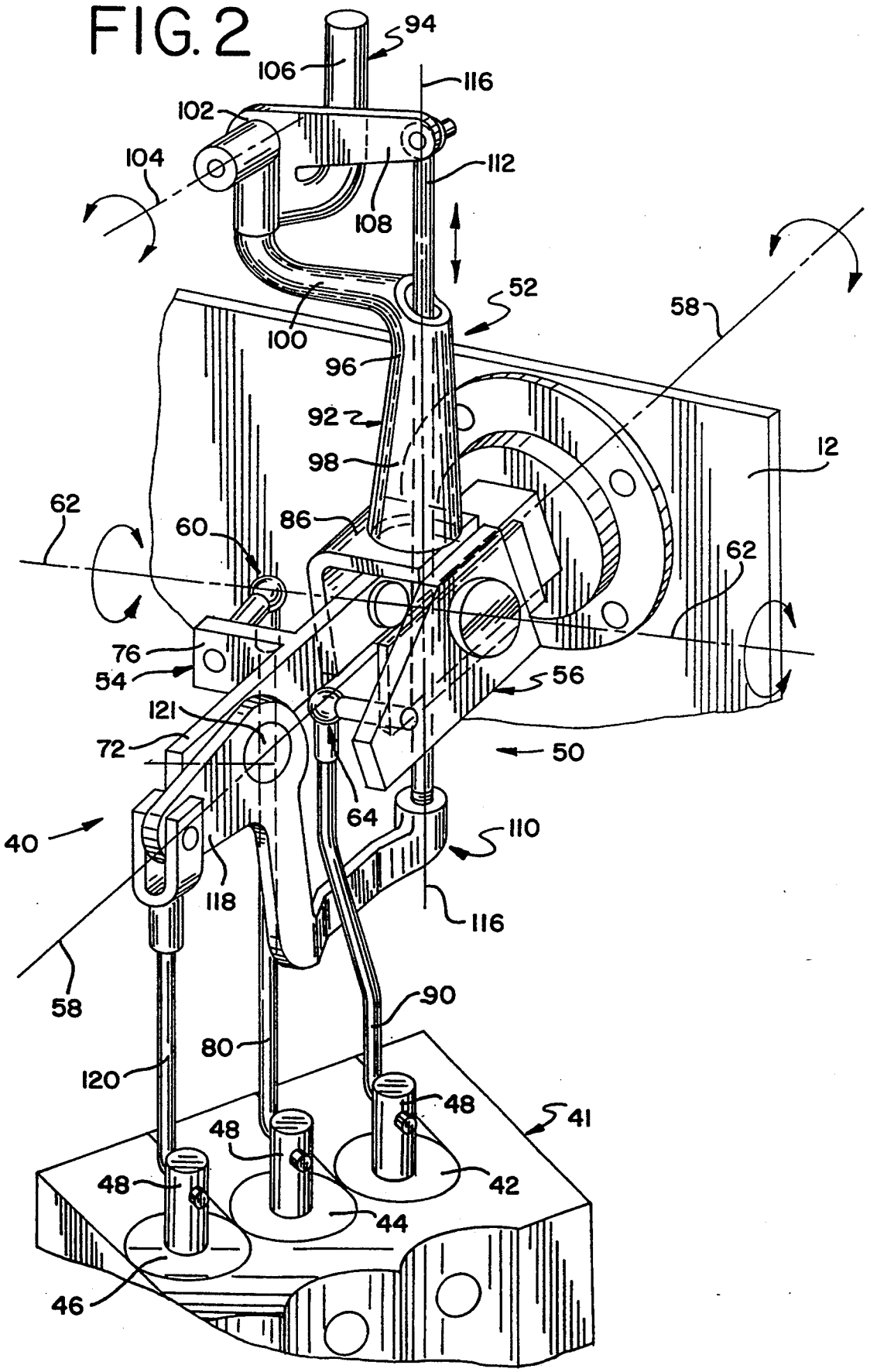
FIG. 2 is a perspective view of one embodiment of a control mechanism according to the present invention.

In the embodiment of the invention illustrated in FIG. 2, the control handle 52 for inducing movements to the controller 50 includes a control lever assembly 92 and an operator handle assembly 94. The control lever assembly 92 includes a vertically elongated control lever 96 having a hollow generally tubular stem portion 98 and an upper end portion 100 which is secured in radially offset relation to the stem portion 98. In the illustrated embodiment, the lower end of the control lever 96 is releasably secured to the bridge portion 86 of the second bracket assembly 56.

Securing the operator handle assembly 94 to the control lever assembly 92 allows for one-handed control over any of the three functions controlled by the controller 50. As shown, handle assembly 94 includes an operator handle 102 which is mounted to the upper portion 100 of control lever 96 for pivotal movement about an axis 104 extending generally parallel to axis 58 of controller 50. The operator handle 102 has a hand grip portion 106 disposed for accessibility to the operator in the cab region of the loader and a radial extension or arm portion 108 which arcuately moves about axis 104 in response to twisting movement of the operator handle 102 to either side of a neutral position.

A force transfer assembly 110 operatively couples the operator handle assembly 94 to valve 46 for controlling a third function in response to twisting movements of the operator handle 102 about axis 104. As shown in FIG. 2, the force transfer assembly 110 comprises an actuator 112 connected to the operator handle 102 and disposed relative to the first and second pivot axes 58 and 62, respectively, such that twisting movements of the operator handle 102 about axis 104 imparts substantially no effect to the valves 44 and 42 connected to the controller 50. Accordingly, the operational functions of the loader mechanism, controlled through induced movements of the controller 50 and twisting movements of the handle assembly 94, can be effected independently or conjointly relative to each other with one-handed control.

In the embodiment of the invention illustrated in FIG. 2, actuator 112 of the force transfer assembly 110 includes a link disposed for vertical reciprocatory movement along an axis or path 116 which intersects with the first and second axes 58 and 62, respectively. Actuator 112 is articulately joined at an upper end to arm portion 108 of handle 102 and extends through the hollow stem portion 98 of the control lever 96.

Figure 5:
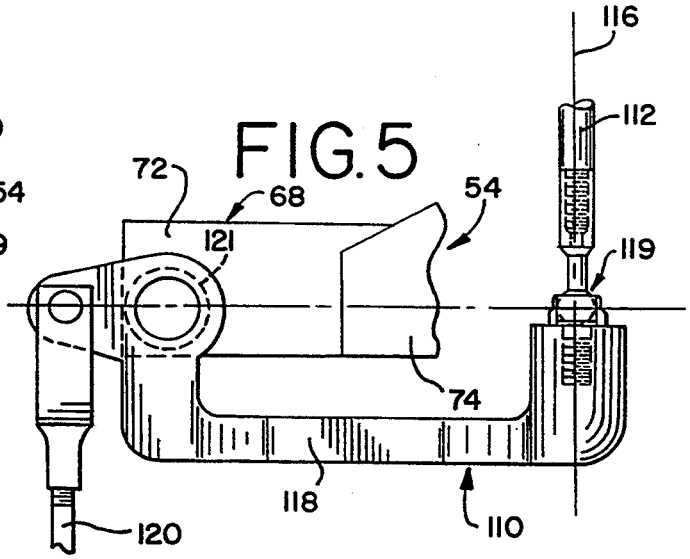
FIG. 5 is a fragmentary side sectional view taken along line 5—5 of FIG. 3.

The force transfer assembly 110 further includes a second link or lever 118 which translates reciprocatory movements of actuator 112 into positional movements for valve 46 thereby effecting articulating operations of the bucket 24. As shown in FIGS. 4 and 5, actuator 112 and link 118 are joined intermediate the bifurcated arm portions 72 and 74 of bracket assembly 54 by a suitable ball joint 119 which substantially eliminates binding forces which would inhibit transfer of motion between actuator 112 and link 118. At its opposite end, linkage 120 joins link 118 to stem portion 48 of valve 46 to control articulated movements of the bucket.

In the illustrated embodiment, link 118 is configured as a bell crank lever which is mounted for pivotal movement intermediate its ends to arm portion 72 of bracket assembly 54. Notably, lever 118 is centered on axis 58 of bracket assembly 54 such that induced movement of the controller 50 about axis 58 will impart no movement to valve 46. As shown in FIGS. 3 and 5, arm portion 72 of bracket assembly 54 is preferably provided with a spherical ball 121 which is received and held within a socket defined by link 118 to allow for side-to-side movements of controller 50 about axis 58 without imparting movement to actuation means 110.

Figure 6:
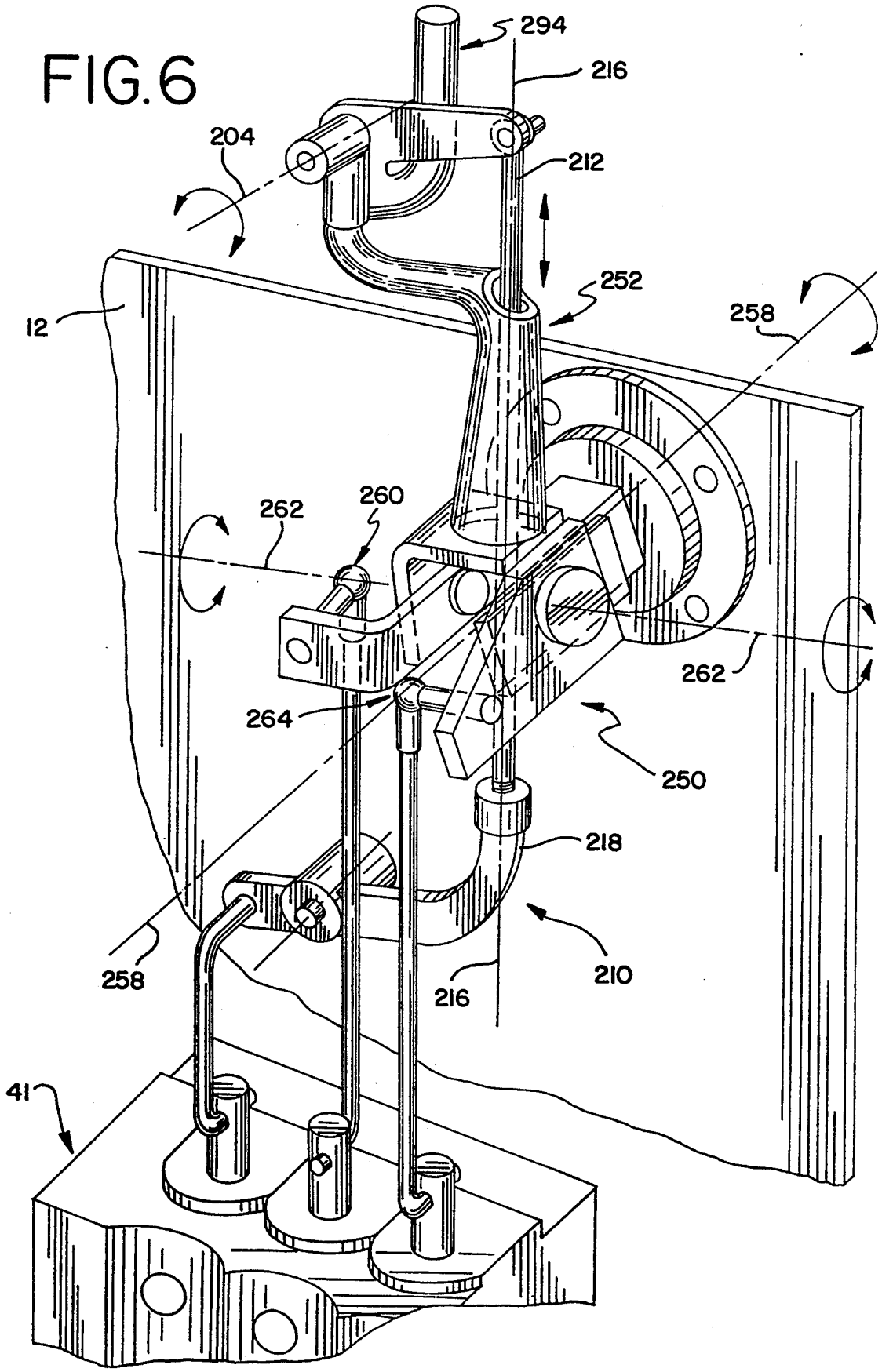
FIG. 6 is a perspective view of a second embodiment of a control mechanism.

In FIG. 6, there is a shown an alternative embodiment of a controller 250 mounted to a frame 12 of an implement of the type schematically represented in FIG. 1. Controller 250 and the elements of which it is comprised is in most respects identical to the controller 50 disclosed in FIGS. 2 through 5. Controller 250 is adapted for rotation about two pivot axes 258 and 262 in response to induced rotation thereof from a control handle 252 including operator handle assembly 294. Moreover, controller 250 includes first and second actuators 260 and 264, respectively, which are substantially identical in location and construction to the actuators 60 and 64 discussed with respect to the earlier disclosed embodiment.

In the embodiment illustrated in FIG. 6, fist and second functions are controlled through induced movement of the controller 252 about axes 258 and 262. More specifically, movement of the control handle 252 in a first arc centered about axis 258 will result in movement of actuator 260 to control a first function. Movement of the control handle 252 in a second arc centered about axis 262 will result in movement of actuator 264 to control a second function.

The controller 250 in the embodiment shown in FIG. 6 includes a force transfer assembly 210 for effecting a third function of the loader in response to twisting movements of the operator handle assembly 294 about axis 204. As will be appreciated, the operator handle assembly 294 is substantially similar in construction and location to the operator handle assembly 94 discussed with respect to the first embodiment.

As in the earlier embodiment, the force transfer assembly 210 includes an actuator 212 connected to handle assembly 294 and to a link or lever 218. Actuator 212 is substantially similar to actuator 112 of controller 50 in that actuator 212 is disposed for vertical reciprocatory movement along a path of travel indicated by an extended reference line 216 which intersects the first and second pivot axes 258 and 262. As such, arcuate movements of the control handle 252 in the directions of the first and second control arcs and about axis 258 and 262 has substantially no effect on the third operation or function of the controller 250. Similarly, twisting movements of the handle means 294 to opposite sides of a neutral position and about axis 204 has no effect on the first and second functions.

In the embodiment of the invention illustrated in FIG. 6, link 218 is configured as a bell crank lever which is mounted between its ends to the frame 12 of the loader. One end of link 218 is connected to the operator handle assembly 294 by actuator 212. In general, link 218 exhibits operating characteristics which are in principal similar to those exhibited by link 118 of controller 50. That is, movement of the operator handle assembly 294 will be translated into functional operation of the loader mechanism in a manner independently and/or conjointly with the other functions affected through one-handed control of the control mechanism.

Notwithstanding the convenience and operational simplicity offered by one-handed control, some operators may prefer a dual handle control 10 mechanism. An advantage of the present invention is that the controller is designed as a modular component that is readily adaptable to one-handed or two-handed controls thus significantly reducing the number of parts required to effect three-function control of an off-highway implement.

Figure 7:
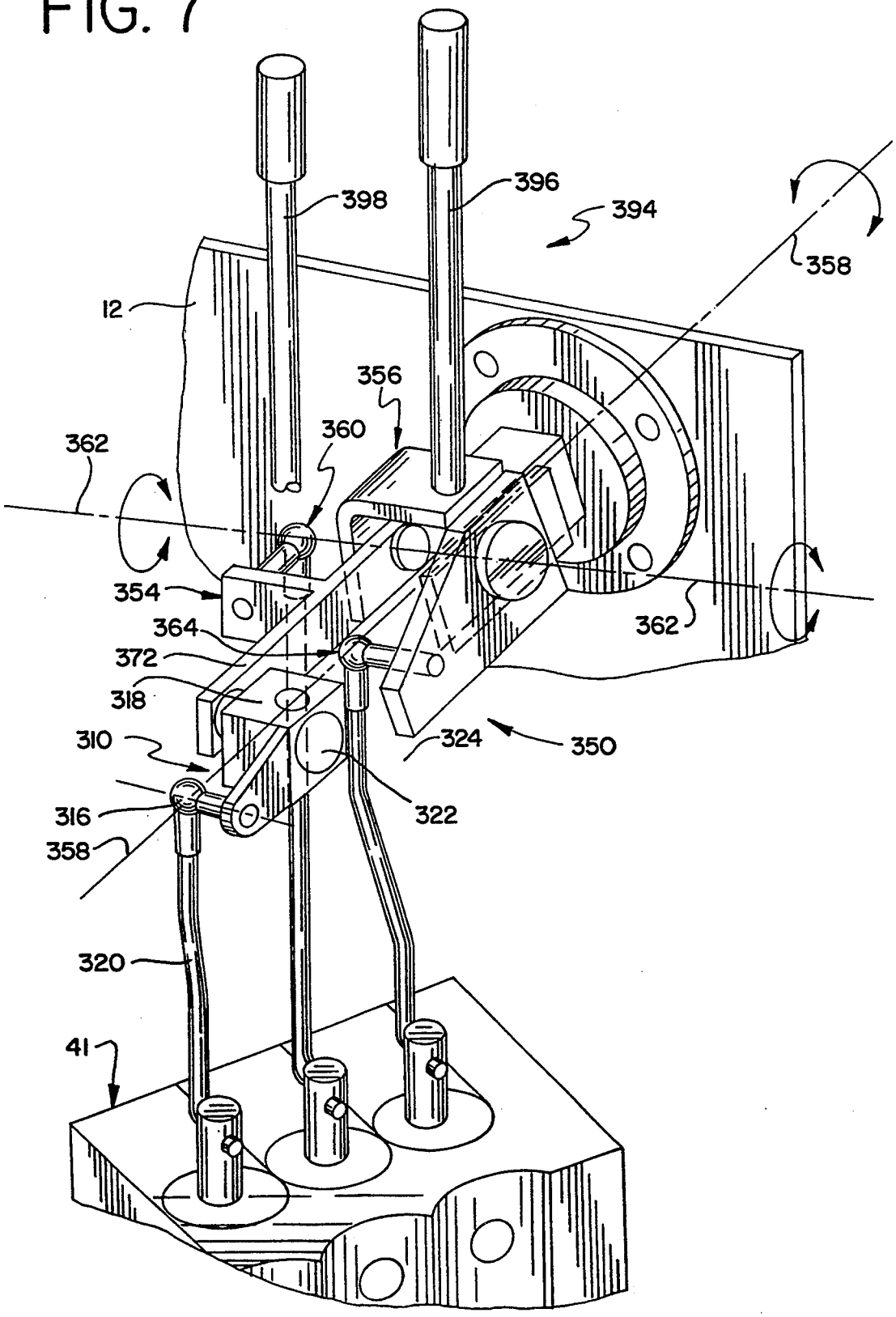
FIG. 7 is a perspective view of a third embodiment of a control mechanism according to the present invention.
Figure 8:
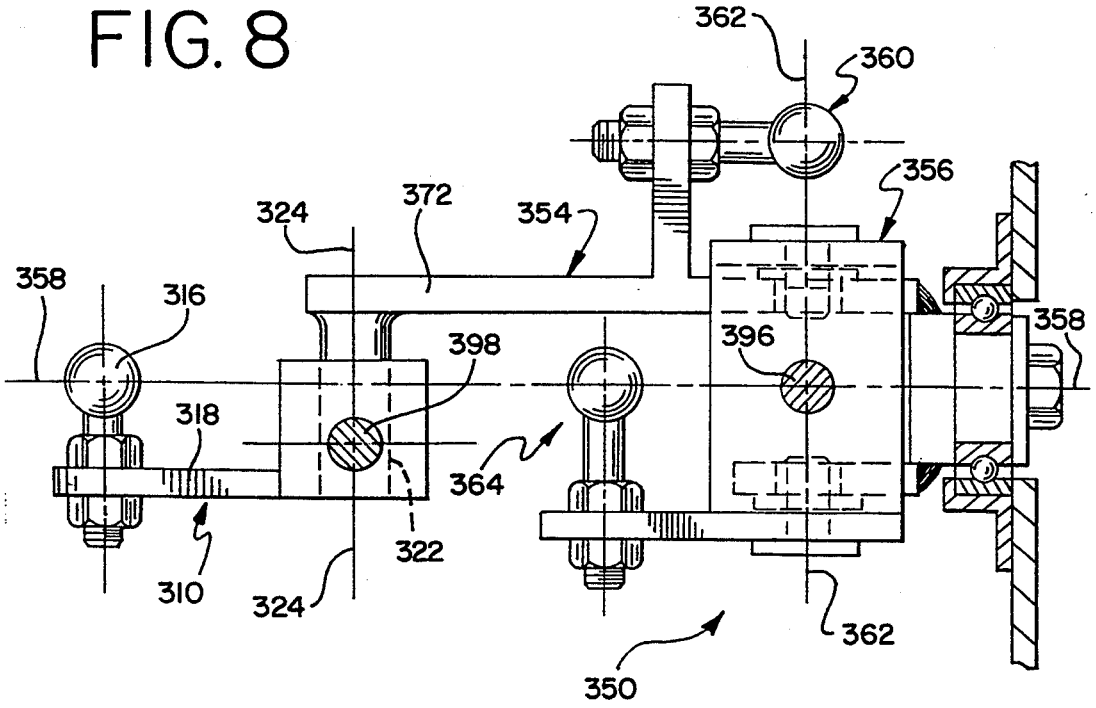
FIG. 8 is a fragmentary top plan sectional view of the control mechanism illustrated in FIG. 7.

FIGS. 7 and 8 disclose another embodiment of a control mechanism including a controller 350 mounted to a frame 12 of the implement of the type schematically represented in FIG. 1. Controller 350 is in most respects identical to the controller 50 disclosed in FIGS. 2 through 5. Controller 350 is adapted for rotation about two axes 358 and 362 in response to induced rotation thereof from a control handle 394. Moreover, controller 350 includes first and second actuators 360 and 364, respectively, which are substantially identical in location and construction to the actuators 60 and 64 discussed with respect to the early disclosed embodiment.

In the embodiment illustrated in FIG. 7, first and second functions are controlled through induced movements of the controller 350 about axes 358 and 362. As will be discussed in detail below, movements of the actuator 360 as a result of induced movements of controller 350 about axis 358 and to opposite sides of a neutral position control a first function. Moreover, movements of the actuator means 364 as a result of induced movements of controller 350 about axis 362 and to opposite sides of a neutral position control a second function.

The controller 350 in the embodiment illustrated in FIGS. 7 and 8 includes a force transfer assembly 310 for effecting a third function in response to proper manipulation of the control handle 394. The force transfer assembly 310 preferably includes a movable actuator 316 with linkage 320 extending to the valve assembly 41 to control one of the three valves in response to movement of the ball actuator 316. Actuator 316 is preferably configured with a spherical coupling or ball joint to substantially eliminate binding forces which inhibit transfer of motion upon movement of the actuation means 310. Notably, actuator 316 is centered on the first pivot axis 358 of the controller 350 such that the operative functions controlled through various movements of the controller 350 can be effected independently or conjointly relative to each other.

In this alternative embodiment of the invention, the control handle 394 includes a first handle 396 and a second handle 398. The first handle 396 has a vertically elongated configuration which is releasably attached at its lower end to a bracket assembly 356 substantially identical to bracket assembly 56 illustrated in FIG. 2. The releasable attachment of the handle 396 to bracket assembly 356 allows handles of different configurations to be attached to and control induced movements of the actuating means of the controller 350. As will be appreciated, an upper end of the handle 396 is readily accessible to the operator in the cab region of the loader.

The second handle 398 is attached to a lever 318 pivotally carried by an arm portion 372 of a bracket assembly 354 which is a component part of controller 350 and is substantially similar in construction to bracket assembly 54 discussed in detail with respect to the earlier embodiment of a controller. An upper end of handle 398 is accessible to the operator in a cab region of the loader.

Lever 318 is mounted for rotation about a shaft 322 defining a fixed axis 324 extending generally parallel to the pivot axes 362. Shaft 322 is fixed to 10 the bracket assembly 354 and the lever 318 is limited to vertical movements about axis 324 and is inhibited from twisting about the shaft 322. The free end of the lever 318 carries the actuator 316. Accordingly, rotation of the second handle 398 in an arc centered about the axis 324 results in movement of the actuator 316 to affect the third function of the controller. It is important to note that side-to-side movement of the second handle 398 likewise induces rotation of the bracket assembly 356 about axis 358 thereby resulting in displacement of actuator means 360. Accordingly, each control handle 396, 398 of the handle 394 is capable of inducing movement to at least two of the actuators on the controller 350 and thereby controlling one or more functions of the loader mechanism in response to movement of the handles about their relative axes.

From the embodiments of the present invention herein disclosed, it will be appreciated that three functions of an off-highway implement can advantageously be affected through the provision of a modular controller which is adapted for rotation about a first axis and that includes first, second, and third actuators each being responsive to induced movement of the controller through a suitable control handle. The first actuator is radially offset from the first axis for effecting a first function in response to induced rotation of the controller. The second actuator is centered on the first axis and is radially offset from a second axis defined by the controller for controlling a second function in response to induced rotation of the controller about the second axis extending generally normal to the first axis. The third actuator of the controller is centered on the first axis and radially spaced from the second axis for effecting a third function in response to induced movement of the third actuator. The control handle is connected to the controller for inducing movement of the first, second, and third actuators relative to their respective axes either independently or conjointly relative to each other thereby effecting independent or conjoint operation of the various functions of the control mechanism. As will be appreciated, the use of a common or modular controller to effect three function control advantageously reduces the number of parts in the control mechanism thereby reducing its complexity and its cost of manufacture.

While particular embodiments of the present invention have been illustrated and described, it will be observed that other modifications and variations can be effected without departing from the true spirit and scope of the novel concept of the present invention. It will be appreciated that the particular embodiments which have been illustrated and described are intended as exemplifications of the invention, and not intended to limit the invention to the specific embodiments illustrated. The disclosure is intended to cover by the appended claims all such modifications as fall within the scope of the claims.

What is claimed is:

1. A three function control mechanism for independently or conjointly controlling three different hydraulic valves of an off-highway implement, with each valve being connected to a hydraulic power source, said control mechanism comprising:

a bracket mounted for movement about a first pivot axis and including a first actuator which is offset from the first pivot axis of said bracket such that said first actuator moves in response to movements of the bracket about said first axis;

a first linkage for operatively coupling the first actuator on said bracket to one of said valves for controlling a first function of the implement;

a control handle connected to and for inducing movement of said bracket in a first direction thereby moving said first actuator and with said control handle being movable in a second direction extending transverse to the first direction and about a second pivot axis to move a second actuator which is in axial alignment with the first pivot axis of said bracket and offset from the second pivot axis, and wherein said second pivot axis transversely extends relative to and intersects the first pivot axis;

a handle linkage for operatively coupling the second actuator on said control handle to another of said valves for controlling a second function of the implement;

an operator handle pivotally connected toward an upper end of said control handle to facilitate one-handed control over the three functions of the control mechanism; and a force transfer assembly for operatively coupling said operator handle to the third valve for controlling a third function in response to pivotal movement of said operator handle, said force transfer assembly including a vertical link connected to said operator handle for reciprocatory movement along a generally vertical path of travel in response to pivotal movement of said operator handle, and wherein the path of travel of said link passes through the intersection of the first and second pivot axes such that pivotal movement of said operator handle imparts substantially no movements to the first and second actuators and thus has no effect regarding the valves connected to said first and second linkages and whereby manipulation of the control handle in the first and second directions conjointly or independently controls the first and second functions of the implement while pivotal movement of the operator handle connected to the control handle controls the third function either independently or conjointly with the other two functions of the implement.

2. The control mechanism according to claim 1 wherein said first and second actuators are normally disposed in substantially the same horizontal plane.

3. The control mechanism according to claim 1 wherein said force transfer assembly further includes a second link for translating vertical reciprocatory movement of the vertical link into positional movements for the third value whereby controlling the third function.

4. The control mechanism according to claim 3 wherein said second link of said force transfer assembly is carried by said bracket and is centered on the first pivot axis, and wherein said second link is connected to said vertical link of said force transfer assembly through a universal joint to inhibit binding forces from interfering with transference of motion therebetween.

5. The control mechanism according to claim 1 wherein said control handle includes a tubular vertical stem portion through which the vertical link of said force transfer assembly extends and an offset portion rigidly secured to an upper end of said stem portion and having said operator handle carried thereby.

6. A control mechanism for independently or conjointly controlling three separate functions of an off-highway implement, said control mechanism comprising:

a bracket assembly including a first actuator with first connecting linkage extending from the first actuator for actuating a first hydraulic valve upon rotation of said bracket assembly about a first axis thereby controlling a first function;

a control handle including a control lever connected to said bracket assembly to allow movement of the control lever through a first arc centered about said first axis and through a second arc centered about a second axis, and with said control handle including second connecting linkage extending from a second actuator centered on the first axis for actuating a second hydraulic valve in response to arcuate movement of said control lever through the second arc thereby controlling a second function;

an operator handle assembly connected to the control lever assembly, said handle assembly including an operator handle pivotally connected toward an upper end of said control lever for movement about an axis extending generally parallel to said first axis and third linkage for connecting said operator handle to a third hydraulic valve thereby controlling a third function, said third linkage including a substantially vertical link connected at one end to said operator handle and extending along a third axis intersecting each of said first and second axes, said vertical link being connected at an opposite end to a lever which translates pivotal movement of the operator handle into positional movements of said third valve; and wherein said control mechanism allows the operator to use a single hand to independently actuate any one of said hydraulic valves through manipulation of either the control handle or the operator handle thereby controlling any one of said functions or to conjointly actuate two or more of said hydraulic valves through manipulation of the control handle and the operator handle thereby controlling two or more of said functions.

7. The three function control mechanism according to claim 6 wherein said bracket assembly further includes a yoke having a pair of spaced parallel arm portions on opposite sides of said first axis and extending from a mounting portion, with said control lever being connected to at least one of the arm portions of said yoke.

8. The three function control mechanism according to claim 7 wherein the lever of said third linkage is carried by and at least partially accommodated between the spaced parallel arm portions of said yoke on the bracket assembly.

9. An three function control mechanism for a loader having a wheeled frame, a loader mechanism supported from the frame for generally vertical movements relative to the frame, said loader mechanism including a pair of loader arms pivotally attached to the frame at one end thereof for movement about a generally horizontal axis, a loader bucket pivotally attached to the distal end of said loader arms, said loader bucket begin articulated for movement about a transversely extending axis between an open position and a closed position, a loader actuation assembly operably associated with the loader mechanism for effecting movement thereof, said actuation assembly including a power source connected to first, second, and third linear actuators for controlling: the elevational function of the bucket relative to the frame, the pivotal function of the bucket relative to said loader arms, and the articulated bucket function; said control mechanism being interposed between said power source and said linear actuators for selectively controlling operation of said loader mechanism, said control mechanism comprising:

a bracket assembly including a first ball joint with first connecting linkage extending therefrom for translating arcuate movements of said first ball joint about a first axis into operable controls for the first linear actuator;

a control handle including an elongated control lever connected to said bracket assembly to allow movement of said control lever in both longitudinal and transverse directions for operably controlling the first and second linear actuators, said control lever being movable through a first arc centered about said first axis to effect movement of the first ball joint thereby effecting actuation of the first linear actuator and through a second arc centered about a second axis to effect actuation of the second linear actuator, said control handle further including second connecting linkage extending from a second ball joint which is centered on the first axis for translating arcuate movements of the second ball joint about said second axis into operable controls for the second linear actuator;

an operator handle assembly carried at a free end of said control lever, said operator handle assembly including an operator handle arranged to be accessible to the operator of said loader and connected to said control lever for pivotal movements and a third linkage for translating pivotal movements of said operator handle into operable controls for the third linear actuator whereby the operator of said loader requires use of only one hand to control all three functions of the loader mechanism either independently of each other or simultaneously relative to each other.

10. The three function control mechanism according to claim 9 wherein said first and second pivot axes intersect with each other, and said third linkage includes a vertical link connected to said operator handle at one end thereof and to a pivotal lever at the opposite end thereof, said vertical link being disposed for vertical reciprocatory movement along a vertical path of travel passing through the intersection of the first and second pivot axes such that reciprocal vertical movements of the vertical link along said path have substantially no effect on the first and second linear actuators and movement of said control handle is either longitudinal and transverse directions has substantially no effect on the third actuator.

11. The three function control mechanism according to claim 10 wherein the pivotal lever of said third linkage of said operator handle assembly is connected intermediate opposite ends thereof to said bracket assembly.

12. The three function control mechanism according to claim 10 wherein said third linkage further includes a ball join interposed between said vertical link and pivotal lever to facilitate free movement therebetween in response to movement of said operator handle.

13. The three function control mechanism according to claim 10 wherein the elongated control lever of said control handle includes a hollow stem portion for accommodating the link of said third linkage for reciprocal movement therewithin and an offset portion which connects the operator handle thereto in offset relation to the reciprocal path of movement of the vertical link of said third linkage.

14. The three function control mechanism according to claim 9 further including a bearing mount for supporting said bracket assembly on the frame of the loader for movement in either rotational direction about said first axis while inhibiting endwise movement of said bracket assembly in a direction extending along said first axis.

* * * * *